United States Patent [19]

Eisenman

[11] 4,016,622

[45] Apr. 12, 1977

[54] BATH SPONGE

[76] Inventor: Carl H. Eisenman, 1609 E. 27th St., Minneapolis, Minn. 55407

[22] Filed: July 14, 1975

[21] Appl. No.: 595,572

[52] U.S. Cl. ..... 15/222

[51] Int. Cl.[2] ..... A47K 7/02

[58] Field of Search ..... 15/104.94, 222, 244 R; 128/58, 63, 67, 270; 272/75, 79 R; 401/8, 201

[56] References Cited

UNITED STATES PATENTS

| | | | |
|---|---|---|---|
| 1,714,687 | 5/1929 | McKeag | 15/222 |
| 2,093,110 | 9/1937 | Meleady | 15/222 |
| 2,305,982 | 12/1942 | Morando | 401/8 |
| 2,544,216 | 3/1951 | Brackmann | 15/222 |
| 2,870,470 | 1/1959 | Looney et al. | 15/244 R X |
| 3,268,938 | 8/1966 | Smith | 15/222 |

FOREIGN PATENTS OR APPLICATIONS

| | | | |
|---|---|---|---|
| 21,443 | 9/1905 | Austria | 272/75 |
| 538,316 | 3/1922 | France | 272/79 R |
| 1,047,837 | 11/1966 | United Kingdom | 15/222 |
| 1,377,945 | 12/1974 | United Kingdom | 15/222 |

*Primary Examiner*—Daniel Blum

*Attorney, Agent, or Firm*—Merchant, Gould, Smith, Edell, Welter & Schmidt

[57] ABSTRACT

A sponge-like body having an elongated cord extending therethrough, said cord having handle elements at its opposite ends. Stop elements on the cord at opposite ends of the body restrict movement of the body longitudinally of the cord.

1 Claim, 4 Drawing Figures

FIG. 1
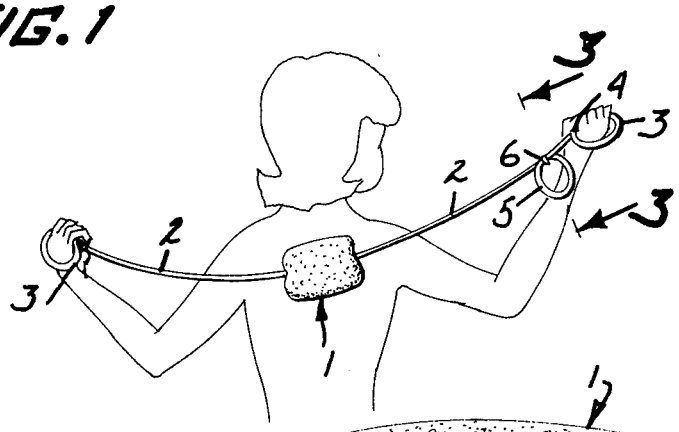
FIG. 2
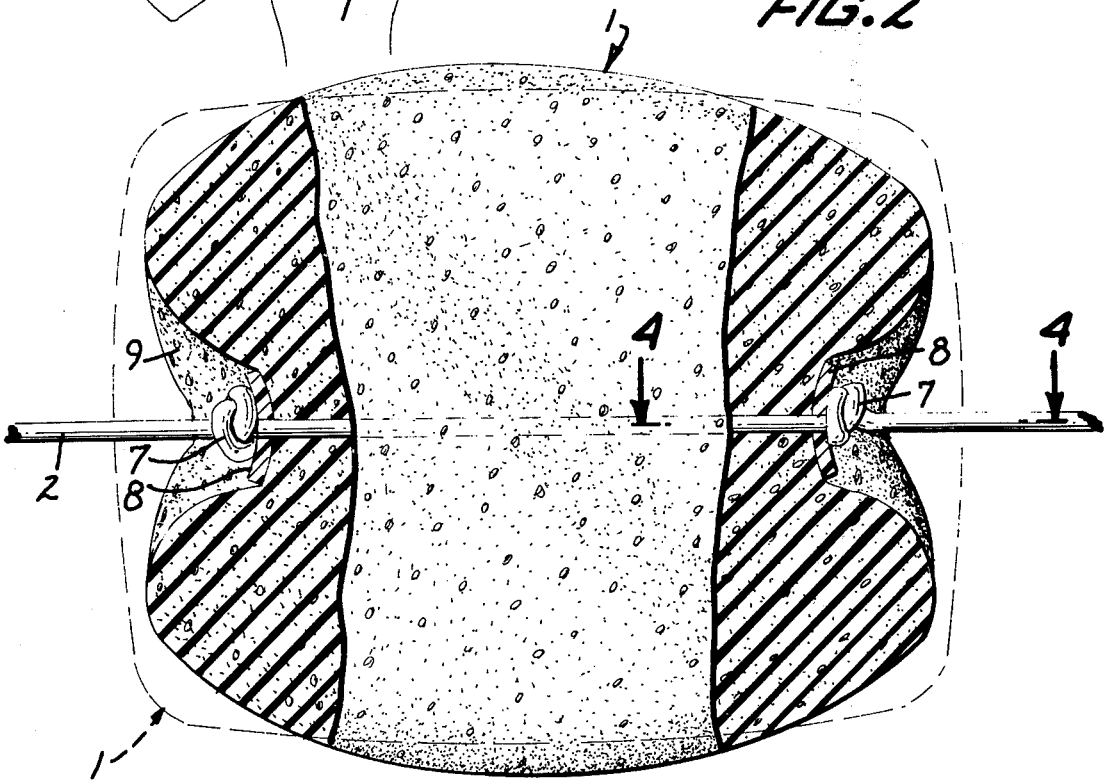
FIG. 3
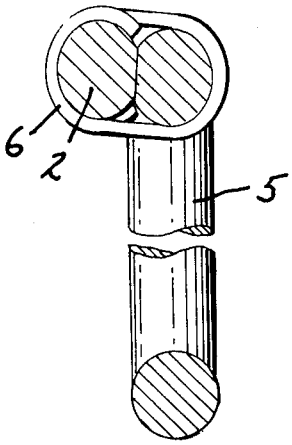
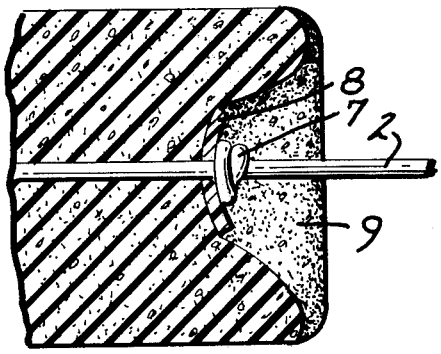
FIG. 4

BATH SPONGE

BACKGROUND OF THE INVENTION

This invention is in the nature of an aid to bathing, particularly in the washing of parts of the body, such as the back between one's shoulders. It has been found that many persons have difficulty in washing their backs, especially those who are advanced in age and afflicted with muscular or other disorders which limit sufficiently free movement of their arms to enable them to reach remote back portions of their bodies.

SUMMARY OF THE INVENTION

I provide a normally generally rectangular body of sponge-like hydrophilic material, an elongated flexible cord extending longitudinally through the body, and stop elements on the cord, each operatively engaging a respective end of the body to restrict movement of the body longitudinally of the cord. The stop elements are spaced apart a distance less than the normal longitudinal dimension of the body, so that the portion of the body adjacent the cord is compressed between the stop elements, the ends of the body defining recesses for the stop elements. The invention further includes handle elements at opposite ends of the cord in spaced relation to the body.

DESCRIPTION OF THE DRAWINGS

FIG. 1 is a fragmentary view in elevation illustrating the bath sponge in use;

FIG. 2 is an enlarged fragmentary view corresponding to a portion of FIG. 1, some parts being broken away and some parts being shown in section;

FIG. 3 is an enlarged fragmentary section taken on the line 3—3 of FIG. 1; and

FIG. 4 is a fragmentary section taken on the line 4—4 of FIG. 2.

DETAILED DESCRIPTION OF THE PREFERRED EMBODIMENT

In the embodiment of the invention illustrated, a normally generally rectangular body is indicated generally at 1, the body being made preferably from compressible spongelike hydrophilic material as is commonly used in producing present day synthetic bath sponges. An elongated flexible cord 2 extends through the body 1 longitudinally thereof. The cord 2 may be made of any suitable material preferably of waterproof synthetic plastics. At its opposite ends, the cord is formed into generally circular loops to provide handle elements 3, the handle elements 3 being held in looped formation by metallic or plastic clips or rings 4.

Intermediate one end of the body 1 and one of the handle elements 3, the cord 2 is looped to provide a secondary handle element 5. Like the element 3, the secondary handle element 5 is held in looped formation by a clip or ring 6.

In producing the present apparatus, a length of cord 2 is threaded longitudinally through the sponge body 1, using a suitable needle-like threading device, not shown. To restrict movement of the body 1 longitudinally of the cord 2, I provide stop means in the nature of a pair of knots 7 tied in the cord 2 at opposite ends of the body 1. A pair of washers 8, preferably of flexible synthetic plastic material or rubber, are mounted on the cord 2, each between one of the knots 7 and its respective end of the body 1.

It will be noted, with reference to FIGS. 2 and 4, that the distance between the knots 7 is substantially less than the normal longitudinal dimension of the body 1, so that the portion of the body 1 adjacent the cord 2 is longitudinally compressed to provide recesses 9 in which the washers 8 and knots 7 are contained. This arrangement not only holds the sponge body 1 against longitudinal sliding movement on the cord 2, but also effectively prevents the knots 7 and washers 8 from accidentally rubbing the user's skin and possibly irritating the same.

A method of using the bath sponge is illustrated in FIG. 1. By grasping each one of the handle elements 3 by a different hand, the user may rub the sponge over the entire back of his or her body with ease, more particularly that portion of the back between the shoulder blades, which is ordinarily hard to reach. The secondary handle element 5 is used in connection with the opposite handle element 3 by persons with shorter arms, such as children. If desired, the cord 2 may be provided with a pair of secondary handle elements 5, not shown, but each disposed between a different handle element 3 and its respective end of the body 1. When the sponge is not in use, any one of the handle elements 3 or 5 may be used to suspend the device from a hook or other suitable device for drying.

While I have shown and described a commercial embodiment of my novel bath sponge, it will be understood that the same is capable of modification without departure from the spirit and scope of the invention, as defined in the claim.

What is claimed is:

1. A bath sponge comprising; a generally rectangular body of sponge-like hydrophilic material, an elongated flexible cord extending longitudinally through said body, said cord having closed loops at its opposite ends defining primary handle elements longitudinally spaced from said body, means for tying said ends of the cord in looped formation, means for restricting movement of said body longitudinally of said cord and comprising a pair of stop elements each operatively engaging a respective end of said body, said stop elements being spaced apart longitudinally of said cord a distance less than the normal longitudinal dimension of said body, whereby the body adjacent said cord is compressed between said stop elements, the opposite ends of said body defining recesses containing said stop elements, said cord being formed to provide a third loop intermediate said body and one of said primary handle elements to define a secondary handle element, and a tie member holding said cord looped to provide said secondary handle element.

* * * * *